US005387091A

United States Patent [19]

Kawaguchi et al.

[11] Patent Number: 5,387,091

[45] Date of Patent: Feb. 7, 1995

[54] VARIABLE CAPACITY TYPE SWASH PLATE COMPRESSOR

[75] Inventors: Masahiro Kawaguchi; masanori Sonobe; Shigeki Kanzaki; Tomohiko Yokono; Kenji Takenaka, all of Kariya, Japan

[73] Assignee: Kabushiki Kaisha Toyoda Jidoshokki Seisakusho, Kariya, Japan

[21] Appl. No.: 105,746

[22] Filed: Aug. 12, 1993

[30] Foreign Application Priority Data

Aug. 21, 1992 [JP] Japan ..... 4-222758

[51] Int. Cl.[6] ..... F04B 49/00; F01B 3/02

[52] U.S. Cl. ..... 417/222.2; 92/12.2

[58] Field of Search ..... 417/222.2, 270, 272; 92/12.2

[56] References Cited

U.S. PATENT DOCUMENTS 4,702,677 10/1987 Takenaka et al. .
4,730,986 3/1988 Kayukawa et al. .
5,056,416 10/1991 Ota et al. ..... 92/12.2
5,181,453 1/1993 Kayakawa et al. ..... 92/12.2
5,228,841 7/1993 Kimura et al. ..... 417/270 X

FOREIGN PATENT DOCUMENTS 61-134580 8/1986 Japan .
62-183082 11/1987 Japan .

*Primary Examiner*—Richard E. Gluck
*Attorney, Agent, or Firm*—Brooks Haidt Haffner & Delahunty

[57] ABSTRACT

A variable capacity type swash plate compressor includes a novel hinge means. The hinge means includes a supporter arm, a main guide pin, and an auxiliary guide pin. The supporter arm is disposed on the rotor projectably therefrom toward the swinging swash plate, and has a main guide hole extending perpendicularly with the driving shaft. The main guide pin is inserted rotatably into the main guide hole. The auxiliary guide pin is inserted slidably into a hole, formed in one of the main guide pin and the swinging swash plate, perpendicularly with the main guide pin at one end, and it is fixed to another one of the main guide pin and the swinging swash plate at the other end. With the hinge means, the top clearances of the pistons can be always maintained virtually uniformly, and the moments resulting from the compression reactive forces can be inhibited from interfering with the discharge capacity control. Additionally, the compressor can attain the reduction in the manufacturing costs.

13 Claims, 12 Drawing Sheets

VARIABLE CAPACITY TYPE SWASH PLATE COMPRESSOR

BACKGROUND OF THE INVENTION

1. Field of the Invention

The present invention relates to a variable capacity type swash plate compressor which is used for an automotive air conditioning system, or the like.

2. Description of the Related Art

There has been a conventional variable capacity type swash plate compressor (hereinafter simply referred to as a "compressor"). Such a conventional compressor is disclosed in Japanese Unexamined Utility Model Publication (KOKAI) No. 62-183,082 or Japanese Unexamined Utility Model Publication (KOKAI) No. 61-134,580. As illustrated in FIG. 12, the conventional compressor 600 includes a driving shaft 610 disposed in a crank chamber 601, a lug plate 620 engaged with and fixed to the driving shaft 610, a rotary driving member 630 connected to the lug plate 620 by way of a connecting pin 640, and a wobble plate 650 supported slidably with the rotary driving member 630. Further, the connecting pin 640 is adapted to swing the rotary driving member 630 back and forth (i.e., in the counterclockwise and clockwise directions in the drawing). Furthermore, a plurality of piston rods 660 are interposed between the wobble plate 650 and a plurality of pistons 670. Moreover, the pistons 670 are disposed reciprocally in a plurality of cylinder bores 680 which are formed in a cylinder block 690. Thus, the rotary movement of the driving shaft 610 is converted into the reciprocal movements of the pistons 670 by way of the rotary movement of the rotary driving member 630. In addition, the pressures in the crank chamber 601 control the inclination angles of the wobble plate 650, thereby varying the strokes of the pistons 670. As a result, the conventional compressor 600 can vary the discharge capacity.

In a supporter arm 621 of the lug plate 620, an arc-shaped slot 622 is formed so as to slidably guide the connecting pin 640 therein. The slot 622 enables the rotary driving member 630 and the wobble plate 650 to incline, and it also regulates the inclining operations. As a result, the top clearances of the pistons 670 can be always maintained virtually uniformly when the compression processes are completed.

When the wobble plate 650 is inclined to the maximum inclination angle and the discharge capacity of the conventional compressor 600 is varied to the maximum, the compression reactive forces act onto the wobble plate 650 by way of the pistons 670 and the piston rods 660, and they are supported with the slot 622 of the lug plate 620. In the conventional compressor 600, the acting points of the compression reactive forces on the wobble plate 650 and the supporting points thereof on the slot 622 are designed so that they are put on the lines which are parallel with the driving shaft 610. Hence, as the wobble plate 650 reduces the inclination angle, the supporting points of the compression reactive forces, acting onto the slot 622 by way of the connecting pin 640, descend in the slot 622, and the acting points of the compression reactive forces, acting onto the wobble plate 650 by way of the piston 670 at the top dead center position and the piston rod 660, ascend relatively with respect to the supporting points.

As a result, the acting points of the compression reactive forces, acting onto the wobble plate 650 by way of the piston 670 at the top dead center position and the piston rod 660, get further away from the driving shaft 610 than are the supporting points of the compression reactive forces, acting onto the slot 622 by way of the connecting pin 640. Consequently, there arise the moments in the clockwise direction in FIG. 12. The moments try to further reduce the inclination angle of the wobble plate 650 according to the compression reactive forces, and thereby they affect the discharge capacity reducing operation so as to be oversensitive. In addition, the moments also try to interfere with the discharge capacity increasing operation considerably, and thereby they affect the discharge capacity increasing operation so as to be dull. All in all, the conventional compressor is not satisfactory in the discharge capacity controllability.

Therefore, the present applicant thought of solving the problem, and he proposed and filed a Patent Application for a compressor with the Japanese Patent Office on Sep. 20, 1991 under Japanese Patent Application Serial No. 3-241,998 (U.S. Pat. No. 5,293,810). The Japanese application was not yet laid-open at the time of the present application, and accordingly it cannot be classified as prior art. The compressor comprises a hinge means which enables to maintain the top clearances of the pistons virtually uniformly in order to improve the discharge capacity controllability, and which inhibits the supporting points of the compression reactive forces from displacing.

As illustrated in FIGS. 10 and 11, the hinge means of the compressor proposed in the application includes a pair of supporter arms 41A, 41B, and a pair of guide pins 44A, 44B. The supporter arms 41A, 41B are disposed in a crank chamber 42 formed with a cylinder block 45, and the like, and they are projected rearwards (i.e., toward a swinging swash plate 46 (shown in FIG. 11) or away from viewers in the drawing) from a rotor 47 (shown in FIG. 11). The guide pins 44A, 44B are disposed in the crank chamber 42, and they are held rotatably with the supporter arms 41A, 41B at their heads, respectively, and they are inserted slidably into a pair of guide holes 43A, 43B at their legs, respectively. The guide holes 43A, 43B are formed in the swinging swash plate 46.

In the hinge means of the compressor proposed in the application, the supporting points "$P_1$" and "$P_2$" of the compression reactive forces are positioned at the heads of the guide pins 44A, 44B which are held rotatably with the supporter arms 41A, 41B, and they are inhibited from displacing when the swinging swash plate varies the inclination angles.

As a result, as illustrated in FIG. 11, the supporting points "$P_1$" and "$P_2$" of the compression reactive forces on the rotor 47, and the acting point "$P_a$" thereof on the swinging swash plate 46 can be positioned at the same distance away from the driving shaft 47, and accordingly hardly any force moments are developed as a result of the compression reactive forces acting onto the swinging swash plate 46 by way of the pistons 48. Hence, the swinging swash plate 46 increases or decreases the inclination angle smoothly, thereby improving the discharge capacity controllability.

However, in the hinge means of the proposed compressor, spherical portions **44*a*, 44*b* are provided at the heads of the guide pins 44A, 44B which are held rotatably by the supporter arms 41A, 41B, and troublesome spherical machining must be carried out. Further, the following constructions are actually required in order to hold the spherical portions 44***a*, 44*b* with the supporter arms 41A, 41B. Namely, spherical holes must be formed in the supporter arms 41A, 41B, and they should be provided with outer ring bushings. The outer ring bushings are made dividable into two component parts having spherical concavities. Furthermore, the outer ring bushings should be inhibited from coming off with circular clips. Thus, in the hinge means, the number of the component parts tends to increase. Hence, the compressor might be associated with the raised manufacturing costs.

SUMMARY OF THE INVENTION

The present invention has been developed in order to improve the compressor which was proposed in U.S. Pat. No. 5,293,810. It is therefore a primary object of the present invention to provide a compressor in which the top clearances of the pistons are maintained virtually uniformly, and in which the moments resulting from the compression reactive forces do not substantially interfere with the discharge capacity control. It is a secondary object of the present invention to provide a compressor which can attain the reduction in the manufacturing costs.

A variable capacity type swash plate compressor according to the present invention can achieve the above mentioned objects.

In accordance with the present invention there is provided a compressor having a housing including a crank chamber, a suction chamber, a discharge chamber, and a plurality of cylinder bores connected to the chambers, each of which is defined and formed therein.

A plurality of pistons are disposed reciprocally in the cylinder bores along with a driving shaft disposed rotatably in the housing, a rotor disposed synchronously rotatably on the driving shaft and placed in the crank chamber, a swinging swash plate disposed about the driving shaft axially and inclinably positionable relative thereto and rotatable therewith, and hinge means disposed between the rotor and the swinging swash plate, the hinge means including: a supporter arm disposed on the rotor projectably toward the swinging swash plate, including a main guide hole extending in a direction perpendicular to the axial direction of the driving shaft; a main guide pin inserted rotatably into the main guide hold; and an auxiliary guide pin extending and crossing perpendicularly with the main guide pin, slidably inserted into an auxiliary guide hole formed in one of the main guide pin and the swinging swash plate at one end, and fixed to the other one of the main guide pin and the swinging swash plate at the other end.

Also included are connecting means disposed between the pistons and the swinging swash plate, and adapted to convert swinging movements of the swinging swash plate into reciprocal movements of the pistons; and means for controlling the pressure in the crank chamber for controlling the inclination of the swinging swash plate to vary the discharge capacity of the compressor.

In the present compressor, the supporter arm of the hinge means includes the main guide hole. Further, it is preferred that the main guide hole is formed in a pair, and the pair of the main guide holes are disposed so as to put the portions of the swinging swash plate, corresponding to the piston at the top dead center position, between themselves, and that they are adapted to hold the both ends of the main guide pin.

In the present compressor, the main guide pin is inserted rotatably into the main guide hole of the supporter arm. Further, it is preferred that a rolling-contact bearing is disposed between the main guide pin and the main guide hole of the supporter arm. The rolling-contact bearing can be a roller bearing, or the like.

In the present compressor, as the swinging swash plate varies the inclination angles according to the pressure differences between the pressures in the crank chamber and the suction pressures, the main guide pin rotates in the main guide hole in the back and forth directions with respect to the rotor, and at the same time the auxiliary guide pin slides in the auxiliary guide hole which is formed in one of the main guide pin and the swinging swash plate. As a result, the swinging swash plate slides and inclines on the driving shaft so as to position the portions thereof, corresponding to the piston at the top dead center position, at a predetermined position. Thus, regardless of the inclination angles of the swinging swash plate, the top clearances of the pistons can be always maintained virtually uniformly.

In accordance with the present compressor, the main guide pin has a column shape preferably. The main guide hole formed in the supporter arm has a barrel shape preferably, and the auxiliary guide hole formed in one of the main guide pin and the swinging swash plate has a barrel shape preferably which simply extends and crosses perpendicularly with the main guide pin. Hence, the troublesome spherical machining is not required at all to manufacture the present compressor. Further, the auxiliary guide pin is fixed to the other one of the main guide pin and the swinging swash plate at the other end by press-fitting, or the like, which can be carried out with ease relatively. Accordingly, the present compressor does not require the outer ring bushings at all, and consequently it enables to reduce the number of the component parts. The outer ring bushings are made dividable in two component parts having spherical concavities, and they are requisite component parts in the compressor proposed in U.S. Pat. No. 5,293,810.

In accordance with the present compressor, the main guide pin is rotatably inserted into the main guide hole which is formed in the supporter arm so as to extend in the direction perpendicular to the axial direction of the driving shaft, and accordingly it scarcely displaces with respect to the rotor. As a result, when the swinging swash plate varies the inclination angles, the supporting points of the compression reactive forces hardly vary the positions on the rotor, and there can hardly arise the moments resulting from the compression reactive forces acting onto the swinging swash plate by way of the pistons. All in all, the moments resulting from the compression reactive forces can be inhibited from interfering with the discharge capacity control.

Specifically speaking, the compression reactive forces acting from the pistons onto the supporter arm are resultant forces which are the combination of the compression forces exerting to the portions of the swinging swash plate, corresponding to the pistons placed at positions ranging from the bottom dead center to the top dead center, and the suction forces exerting to them, corresponding to the pistons placed at positions ranging from the top dead center to the bottom dead center. Namely, the acting points of the compression reactive forces acting from the pistons onto the swinging swash plate do not coincide precisely with the portions of the swinging swash plate, corresponding to the piston at the top dead center position, and they fluctuate in the rotary direction of the swinging swash plate. Consequently, in the case that a single supporter arm is placed at a position which coincides with the portions of the swinging swash plate, corresponding to the piston at the top dead center position, the acting points of the compression reactive forces and the supporting points thereof on the supporter arm might displace each other in the rotary direction of the swinging swash plate so that there might arise the bending moments between the main guide pin and the main guide hole of the supporter arm. As a result, the main guide pin might be less likely to rotate smoothly in the main guide hole because the main guide pin might be pinched with the main guide hole. In particular, such an unsatisfactory operation might be likely to arise when the swinging swash plate inclines at smaller inclination angles and the compression reactive forces rotating the main guide pin are smaller, and when it inclines from the smaller inclination angles to the larger inclination angles (i.e., when the present compressor is operated at lower compression ratios). Hence, the discharge capacity control might not be carried out effectively, for instance, there might arise poor responses, or the like, to the enlargements of the compression ratios.

In order to avoid the possible unfavorable operations, the present compressor can include the supporter arm which is constructed to include a pair of the main guide holes adapted to support the ends of the main guide pin, respectively, thereby putting the portions of the swinging swash plate, corresponding to the piston at the top dead center position, therebetween. If such is the case, the compression reactive forces can be dividedly supported with a pair of supporting points, and accordingly there arise no bending moments between the main guide pin and the main guide holes of the supporter arm. Therefore, the main guide pin can rotate further smoothly in the main guide holes.

Moreover, the present compressor can include a rolling contact bearing which is disposed between the main guide pin and the main guide hole of the supporter arm. If such is the case, even when there arise bending moments between the main guide pin and the main guide hole of the supporter arm, the main guide pin can rotate furthermore smoothly in the main guide hole, independent of the bending moments, because the rolling-contact bearing provides a lower friction coefficient therebetween.

As having been described so far, the present compressor comprises the novel hinge means. The hinge means includes the supporter arm, the main guide pin, and the auxiliary guide pin. With the hinge means, the top clearances of the pistons can be always maintained virtually uniformly, and the moments resulting from the compression reactive forces can be inhibited from interfering with the discharge capacity control. Additionally, the present compressor can attain the reduction in the manufacturing costs.

Further, when the present compressor comprises the hinge means which includes a pair of the supporter arms disposed so as to put the portions of the swinging swash plate, corresponding to the top dead center position, therebetween, the main guide pin comes to rotate in the main guide hole further smoothly. Accordingly, the moments resulting from the compression reactive forces can be inhibited from interfering with the discharge capacity control further effectively.

Furthermore, when the present compressor comprises the hinge means which includes the rolling-contact bearing disposed between the main guide pin and the main guide hole of the supporter arm, the main guide pin comes to rotate in the main guide hole furthermore smoothly. Accordingly, the moments resulting from the compression reactive forces can be inhibited from interfering with the discharge capacity control furthermore effectively.

All in all, when the present compressor is incorporated into an automotive air conditioning system, optimum air conditioning operations can be carried out without increasing the manufacturing costs.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

First Preferred Embodiment

Figure 1:
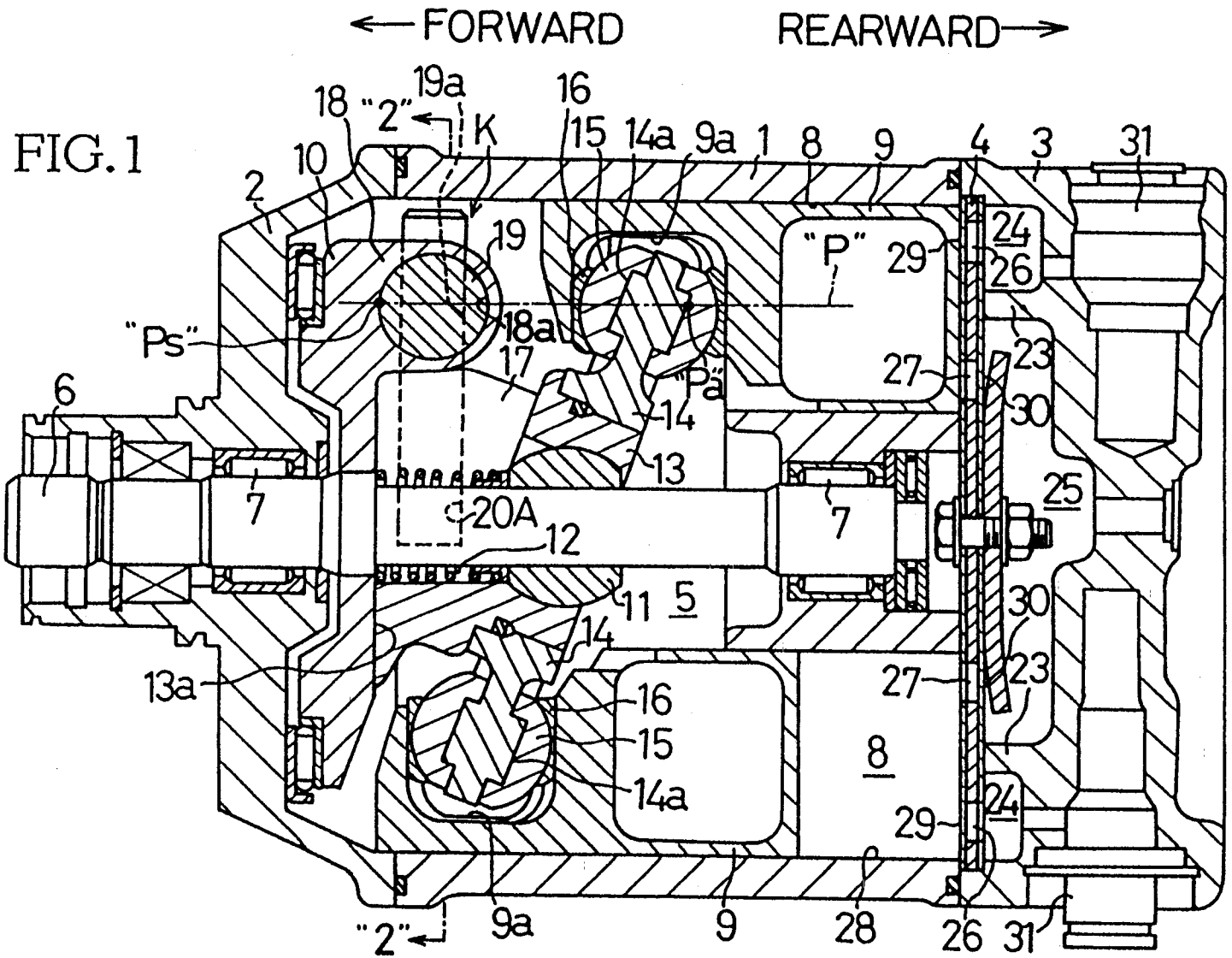
FIG. 1 is a longitudinal cross-sectional view of a First Preferred Embodiment of a compressor according to the present invention.

As illustrated in FIG. 1, in the First Preferred Embodiment of the present compressor, a cylinder block 1 is connected to a front housing 2 at one end, and it is connected to a rear housing 3 by way of a valve plate 4 at the other end. A crank chamber 5 is formed with the front housing 2 and the cylinder block 1. A driving shaft 6 is disposed in the crank chamber 5, and it is held rotatably with a pair of bearings 7, 7 disposed at the ends. A plurality of cylinder bores 8 are formed at positions around the driving shaft 6 in the cylinder block 1. A piston 9 is inserted into each of the cylinder bores 8, and each piston is disposed so that its axial center line is parallel with the axial center line of the driving shaft 6.

In the crank chamber 5, a rotor 10 is disposed synchronously rotatably on the driving shaft 6, and a spherical sleeve 11 is disposed rotatably and slidably thereon. An urging spring 12 is interposed between the rotor 10 and the spherical sleeve 11, and it is adapted to urge the spherical sleeve 11 toward the rear housing 3. On the spherical sleeve 11, a rotary driving member 13 is disposed swingably back and forth, and it is formed in an annular shape which surrounds the spherical sleeve 11. When the urging spring 12 is contracted to the maximum as illustrated in FIG. 1, the rotary driving member 13 is brought into contact with the rotor 10 at a contact surface 13*a* formed obliquely at the lower portion on the rear surface, and accordingly it is regulated so as not to incline and increase the inclination angle any further.

A swinging swash plate 14 is fitted around the outer periphery of the rotary driving member 13, and it has a ring-shaped supporter rail 14*a* on both of the surfaces. The supporter rails 14*a*, 14*a* are disposed around the axial center line of the driving shaft 6, and they are engaged with a semi-columnar-shaped inner shoe 15 whose center line is parallel with the circumferential direction of the swinging swash plate 14. The inner shoes 15, 15 are inhibited from displacing in the radial directions of the swinging swash plate 14, and they are engaged with semi-columnar-shaped outer shoes 16, 16 on the outer peripheral surfaces, respectively. The outer shoes 16, 16 are machined in a semi-columnar shape on the inner surface, and they have an outer surface which extends in the direction perpendicular to the axial direction of the driving shaft 6. The outer shoes 16, 16 are engaged with barrel-shaped supporter surfaces of the pistons 9 at the outer surfaces. The barrel-shaped supporter surfaces are machined so as to form a swash plate receiving groove 9*a* at the neck of the pistons 9, and they are formed in column shapes facing each other. Thus, a plurality of the pistons 9 are installed to the swinging swash plate 14 by way of the inner shoes 15, 15 and the outer shoes 16, 16, and they are accommodated reciprocally in the cylinder bores 8.

Figure 2:
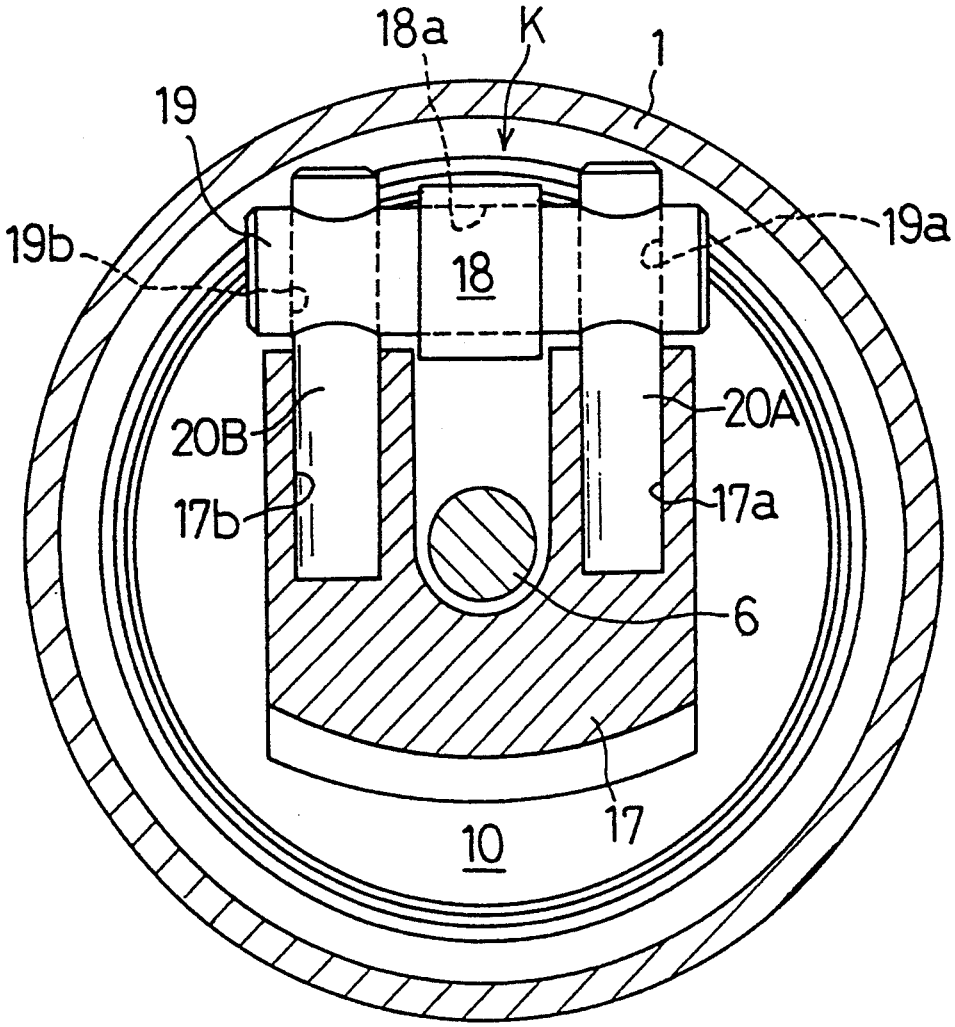
FIG. 2 is a lateral cross-sectional view of the First Preferred Embodiment of the present compressor taken along line "2"—"2" of FIG. 1.

As illustrated in FIG. 1, on the front surface of the rotary driving member 13 (i.e., on the left-hand side surface thereof in the drawing), there is disposed a bracket 17 projectably therefrom. As illustrated in FIG. 2, the bracket 17 has a virtually letter "U" shape, and it holds the driving shaft 6 between its vertical arms.

As best shown in FIG. 1, on the upper rear surface of the rotor 10, there is disposed a supporter arm 18, constituting a hinge means "K," projectably therefrom. The supporter arm 18 extends rearwards in the axial direction of the driving shaft 6 (i.e., in the right direction in the drawing) so as to face the middle of the bracket 17. At the leading end of the supporter arm 18, there is formed a barrel-shaped main guide hole 18*a* extending in the direction perpendicular to the axial direction.

Turning now to FIG. 2, into the main guide hole 18*a*, a columnar-shaped main guide pin 19 is inserted rotatably. The main guide pin 19 is provided with auxiliary guide holes 19*a*, 19*b*, penetrating therethrough in the diametrical direction, at the ends. Into the auxiliary guide holes 19*a*, 19*b*, a pair of columnar-shaped auxiliary guide pins 20A, 20B, extending and crossing perpendicularly with the main guide pin 19, are inserted slidably at the top ends. The auxiliary guide pins 20A, 20B are press-fitted into holes 17*a*, 17*b*, which are adapted for press-fitting and formed in the bracket 17, at the other ends.

In particular, the main guide pin 19 has a column shape. The main guide hole 18*a* formed in the supporter arm 18 has a barrel shape, and the auxiliary guide holes 19*a*, 19*b* formed in the main guide pin 19 have a barrel shape which extends and crosses perpendicularly with the main guide pin 19. Hence, the troublesome spherical machining is not required at all to manufacture the First Preferred Embodiment of the present compressor. Further, the auxiliary guide pins 20A, 20B are fixed to the bracket 17 at the bottoms by press-fitting, which can be carried out with ease relatively. Accordingly, the First Preferred Embodiment does not require the outer ring bushings at all, and consequently it enables to reduce the number of the component parts. The outer ring bushings are made dividable in two component parts and fixed with a circular clip, they have spherical concavities, and they are requisite component parts in the compressor proposed in U.S. Pat. No. 5,293,810.

Turning now back to FIG. 1, the rear housing 3 is divided into suction chambers 24, 24 and a discharge chamber 25 with separator walls 23, 23. In the valve plate 4, there are opened suction openings 26 and discharge openings 27 at positions corresponding to the cylinder bores 8. Compression chambers 28 are formed between the valve plate 4 and the pistons 9, and they are communicated with the suction chambers 24 and the discharge chamber 25 by way of the suction openings 26 and the discharge openings 27. The suction openings 26 and the discharge openings 27 are provided with a suction valve 29 and a discharge valve 30, respectively. The suction valves 29 and the discharge valves 30 open and close the suction openings 26 and the discharge openings 27 according to the reciprocal movements of the pistons 9. In addition, the rear housing 3 is provided with control valves 31, 31 which adjust the pressures in the crank chamber 5.

The thus constructed First Preferred Embodiment of the present compressor operates as follows. When the swinging swash plate 14 rotates as the driving shaft 6 rotates, the inner shoes 15, 15 slide on the supporter rails 14*a*, 14*a* with respect to the swinging swash plate 14 in the circumferential direction. Since the inner shoes 15, 15 are engaged with the pistons 9 by way of the outer shoes 16, 16, the pistons 9 reciprocate in the cylinder bores 8. As a result, the refrigerating gas is sucked into the the cylinder bores 8 from the suction chambers 24, and it is compressed therein. Thereafter, the refrigerating gas is discharged out to the discharge chamber 25. During the operations, the discharge capacity to be discharged out to the discharge chamber 25 is controlled by adjusting pressures in the crank chamber 5 with the control valves 31, 31 in a manner taught by U.S. Pat. No. 4,730,986, which is incorporated by reference.

Figure 3:
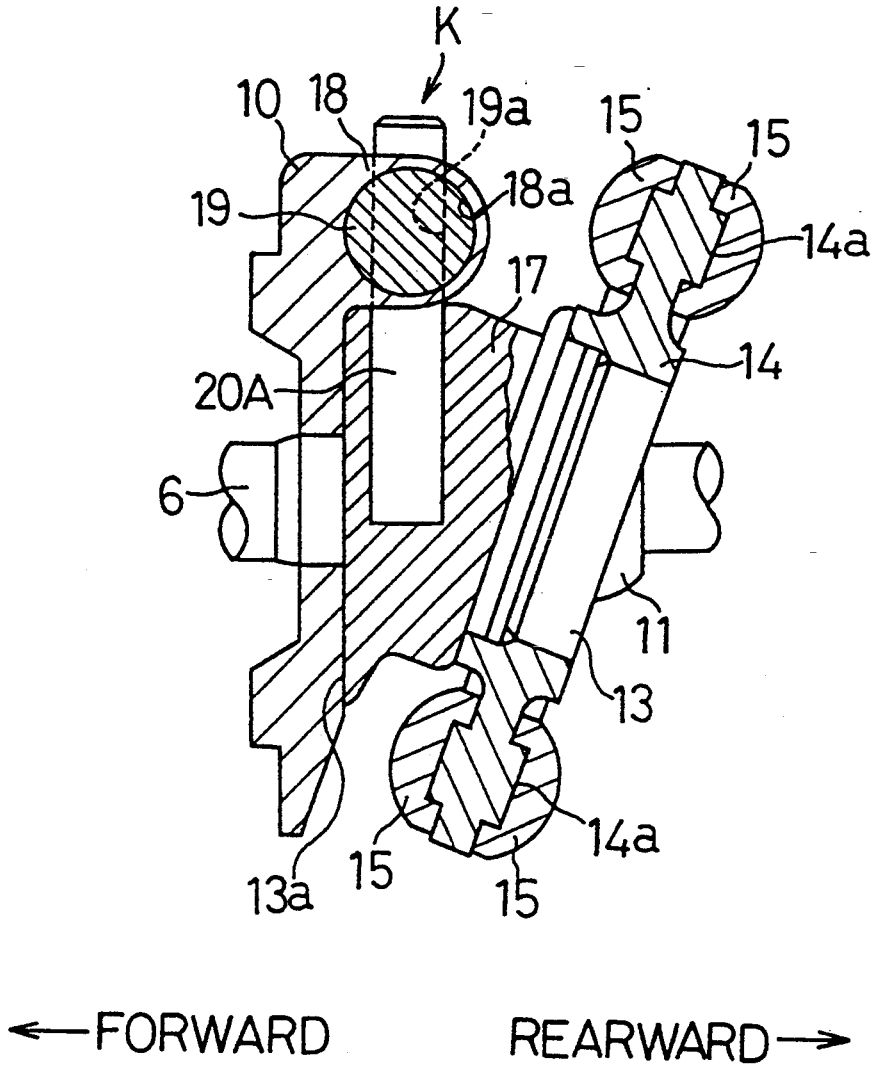
FIG. 3 is a longitudinal cross-sectional view of the First Preferred Embodiment of the present compressor, and it illustrates component parts around a hinge means when a swinging swash plate is inclined to the maximum inclination angle.
Figure 4:
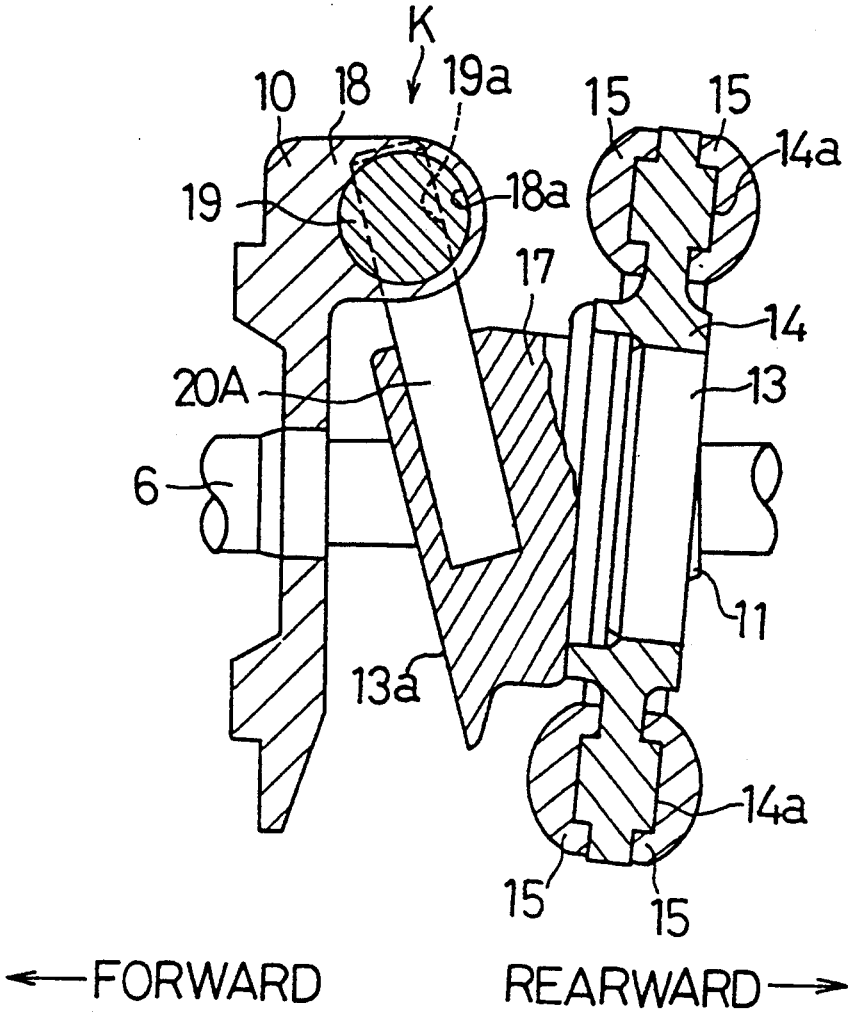
FIG. 4 is a longitudinal cross-sectional view of the First Preferred Embodiment of the present compressor, and it illustrates the component parts around the hinge means when the swinging swash plate is inclined to the minimum inclination angle.

For instance, when the pressures in the crank chamber 5 are lowered by the pressure adjustment with the control valves 31, 31, the back pressure exerting onto the pistons 9 are lowered, and accordingly the inclination angle of the swinging swash plate 14 is increased. In the hinge means "K," as can be understood from FIG. 4, the main guide pin 19 is rotated in the main guide hole 18*a* in the rearward direction (i.e., in the clockwise direction in the drawing) with respect to the rotor 10. Consequently, the rotary driving member 13 is swung about the spherical sleeve 11 in the rearward direction, and the spherical sleeve 11 is advanced in the forward direction against the urging force of the urging spring 12. At the same time, the auxiliary guide pins 20A, 20B are slid upward in the auxiliary guide holes 19*a*, 19*b* formed in the main guide pin 19, and thereby the inclination angle of the swinging swash plate 12 is increased. In the meantime, the outer shoes 16, 16 are slid with respect to the inner shoes 15, 15 in the circumferential direction, and they are also slid inward to the center in the swash plate receiving grooves 9*a*. As a result, the swinging swash plate 14 varies the inclination angle from the state shown in FIG. 4 to the state shown in FIG. 3. Thus, the strokes of the pistons 9 are extended to increase the discharge capacity. When the inclination angle of the swinging swash plate 14 is increased to the maximum by these operations, the present compressor can be operated at the maximum discharge capacity continuously.

On the other hand, when the crank chamber 5 and the suction chambers 24 are shut off with the control valves 31, 31 and the pressures in the crank chamber 5 are raised by the blowby gas resulting therefrom, the back pressure exerting onto the pistons 9 is raised, and accordingly the inclination angle of the swinging swash plate 14 is decreased. In the hinge means "K," as can be understood from FIG. 3, the main guide pin 19 is rotated in the main guide hole 18*a* in the forward direction (i.e., in the counterclockwise direction in the drawing) with respect to the rotor 10. Consequently, the rotary driving member 13 is swung about the spherical sleeve 11 in the forward direction, and the spherical sleeve 11 is retracted in the rearward direction by the urging force of the urging spring 12. At the same time, the auxiliary guide pins 20A, 20B are slid downward in the auxiliary guide holes 19*a*, 19*b* formed in the main guide pin 19, and thereby the inclination angle of the swinging swash plate 12 is decreased. In the meantime, the outer shoes 16, 16 are slid with respect to the inner shoes 15, 15 in the circumferential direction, and they are also slid outward off the center in the swash plate receiving grooves 9*a*. As a result, the swinging swash plate 14 varies the inclination angle from the state shown in FIG. 3 to the state shown in FIG. 4. Thus, the strokes of the pistons 9 are contracted to decrease the discharge capacity. When the inclination angle of the swinging swash plate 14 is decreased to the minimum by these operations, the present compressor can be operated at the minimum discharge capacity continuously.

During the operations of the First Preferred Embodiment of the present compressor at the maximum and minimum discharge capacities, the swinging swash plate 14 slides on the driving shaft 6 and inclines while positioning the portions thereof, corresponding to the piston 9 at the top dead center position, at the predetermined position. Accordingly, regardless of the inclination angles of the swinging swash plate 14, the top clearances of the pistons 9 are always maintained virtually uniformly.

Further, in the present compressor, the supporter arm 18 is provided with the main guide hole 18*a* extending in the direction perpendicular to the axial direction of the driving shaft 6, and the main guide pin 19 is inserted rotatably into the main guide hole 18*a* of the supporter arm 18 as illustrated in FIG. 2. Consequently, the main guide pin 19 cannot be displaced with respect to the rotor 10, and thereby the supporting points of the compression reactive forces exerting onto the rotor 10 are not varied. Namely, as illustrated in FIG. 1, the acting point "$P_a$" of the compression reactive forces exerting onto the swinging swash plate 14 by way of the piston 9 at the top dead center position, and the supporting point "$P_s$" thereof exerting onto the rotor 10 by way of the main guide pin 19 can be put on an imaginary plane "P" containing the axial center line of the piston 9. All in all, the swinging swash plate 14 is hardly subjected to the moments which result from the compression reactive forces exerting thereto by way of the pistons 9. Hence, it is possible to inhibit the moments resulting from the compression reactive forces from interfering with the discharge capacity control.

Furthermore, in the present compressor, the bracket 17 is formed in the letter "U" shape substantially as illustrated in FIG. 2, and it is disposed on the front surface of the rotary driving member 13 as illustrated in FIG. 1. The dynamic imbalances associated with the rotation of the rotary driving member 3 are absorbed by the bracket 17 effectively. Therefore, there scarcely arise the vibrations or the like which result from the variations of the load balance. Thus, the rotary driving member 13 and the swinging swash plate 14 come to rotate stably.

As having been detailed so far, in accordance with the First Preferred Embodiment of the present compressor, not only it is possible to always maintain the top clearances of the pistons 9 virtually uniformly, but also it is possible to inhibit the moments resulting from the compression reactive forces from interfering with the discharge capacity control. In addition, it is possible to attain the reduction in the manufacturing costs.

Second Preferred Embodiment

Figure 5:
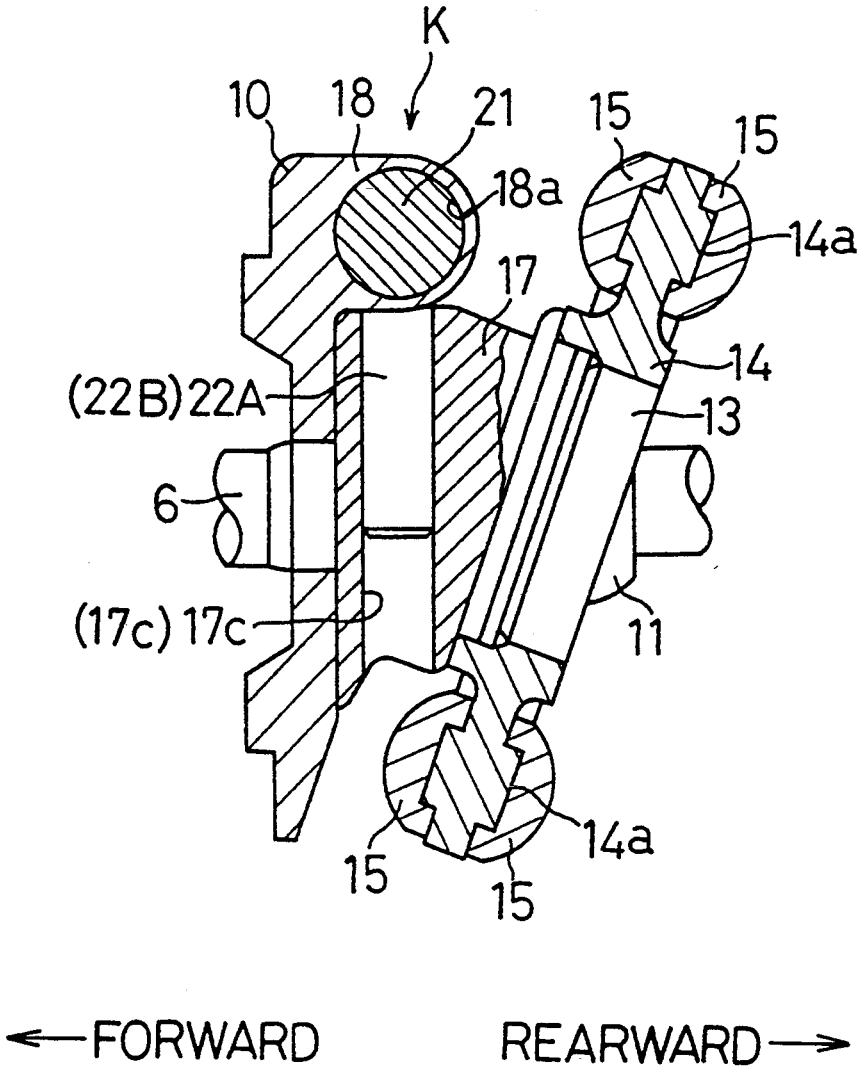
FIG. 5 is a longitudinal cross-sectional view of a Second Preferred Embodiment of a compressor according to the present invention, and it illustrates component parts around a hinge means when a swinging swash plate is inclined to the maximum inclination angle.
Figure 6:
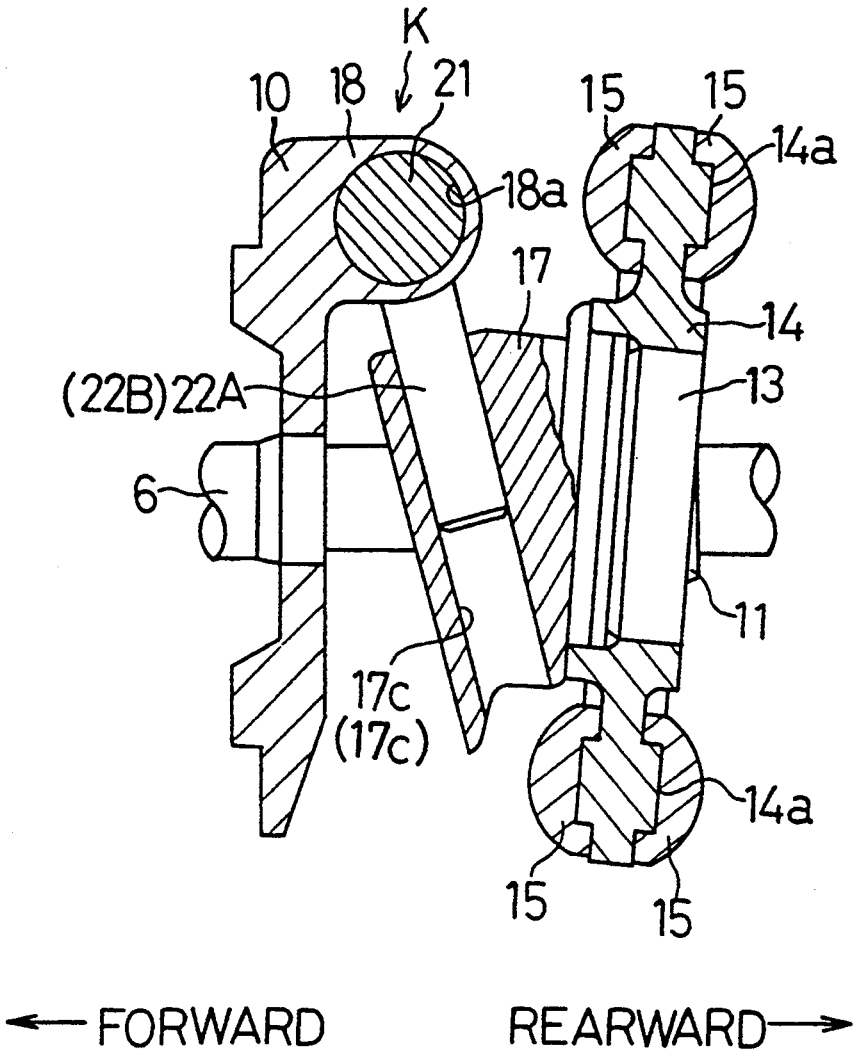
FIG. 6 is a longitudinal cross-sectional view of the Second Preferred Embodiment of the present compressor, and it illustrates the component parts around the hinge means when the swinging swash plate is inclined to the minimum inclination angle.

The Second Preferred Embodiment of the present compressor will be hereinafter described with reference to FIGS. 5 and 6. FIGS. 5 and 6 illustrate the component parts around the hinge means "K" of the Second Preferred Embodiment. The other constructions of the Second Preferred Embodiment are identical with those of the First Preferred Embodiment, and accordingly they are designated with the same reference numerals but will not be described hereinafter in detail.

In the hinge means "K," a columnar-shaped main guide pin 21 is inserted rotatably into the main guide hole 18*a* of the supporter arm 18. A pair of columnar-shaped auxiliary guide pins 22A, 22B (not shown in FIGS. 5 and 6), extending and crossing perpendicularly with the main guide pin 21, are welded to the main guide pin 21 at their upper ends, and they are inserted slidably into a pair of auxiliary guide holes 17*c*, 17*c* (one of them, not shown in FIGS. 5 and 6) at their lower ends. The auxiliary guide holes 17*c*, 17*c* are formed in the bracket 17.

In particular, the main guide pin 21 has a column shape. The main guide hole 18*a* formed in the supporter arm 18 has a barrel shape, and the auxiliary guide holes 17*c*, 17*c* formed in the bracket 17 are barrel shape. Hence, troublesome spherical machining is not required at all to manufacture the Second Preferred Embodiment of the present compressor. Further, the auxiliary guide pins 22A, 22B are welded to the main guide pin 21 at the upper ends, which can be carried out with ease relatively. Accordingly, the Second Preferred Embodiment enables to reduce the number of the component parts.

The thus constructed hinge means "K" of the Second Preferred Embodiment of the present compressor operates as follows. In the hinge means "K," as can be understood from FIGS. 5 and 6, the main guide piston 21 is rotated in the main guide hole 18*a* in the rearward or forward direction with respect to the rotor 10. Consequently, the rotary driving member 13 is swung about the spherical sleeve 11 in the rearward or forward direction, and the spherical groove 11 is advanced or retracted in the forward or rearward direction against or for the urging force of the urging spring 12. At the same time, the auxiliary guide pins 22A, 22B are slid downward or upward in the auxiliary guide holes 17*c*, 17*c* formed in the bracket 17, and thereby the inclination angle of the swinging swash plate 14 is increased or decreased. Thus, the Second Preferred Embodiment varies the discharge capacity between the states shown in FIGS. 5 and 6, and accordingly it can be operated at the controlled discharge capacities continuously.

It is apparent from the foregoing descriptions that the Second Preferred Embodiment of the present compressor can produce the advantageous effects similarly to those produced by the First Preferred Embodiment.

In addition, as illustrated in FIGS. 5 and 6, the auxiliary guide holes 17*c*, 17*c* are formed in through holes which penetrate through the bracket 17 of the swinging swash plate 14. With this construction, the oil contained in the refrigerating gas can be supplied to the sliding contacts between the auxiliary guide pins 22A, 22B and the auxiliary guide holes 17*c*, 17*c* from the crank chamber 5, and thereby the swinging swash plate 14 can vary the inclination angle smoothly.

Third Preferred Embodiment

Figure 7:
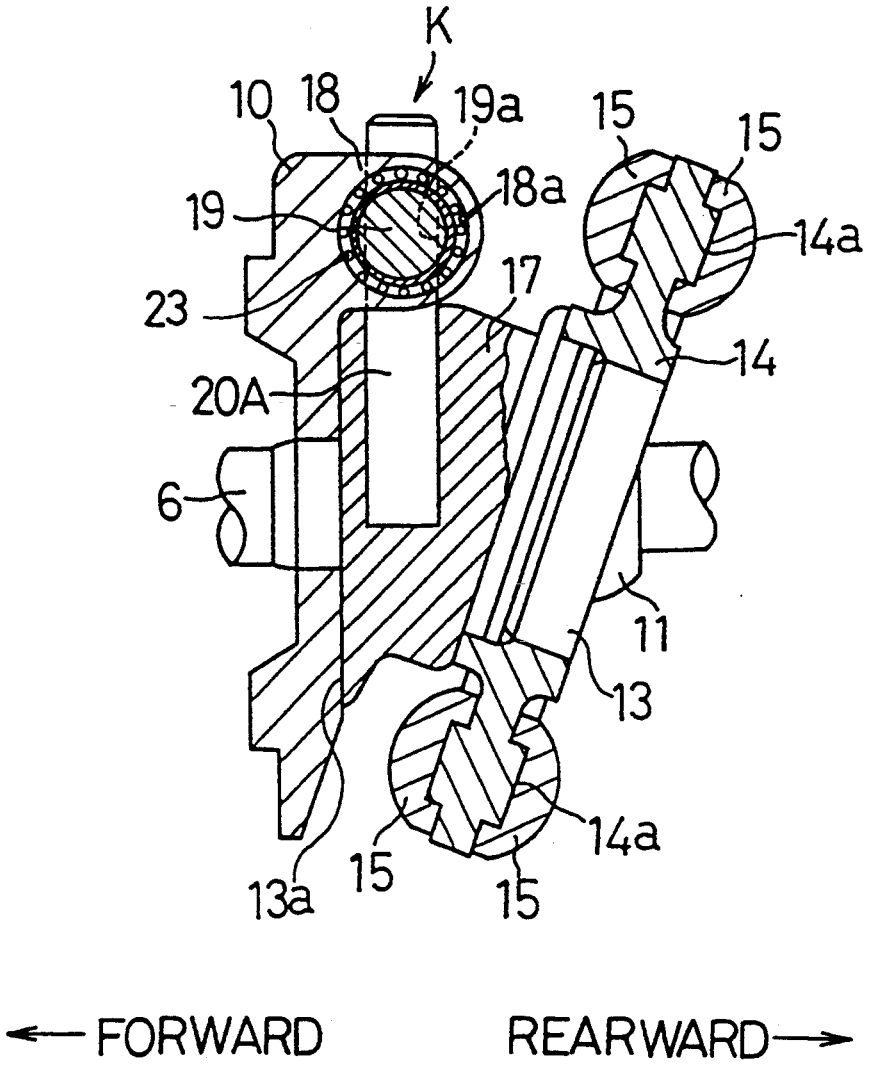
FIG. 7 is a longitudinal cross-sectional view of a Third Preferred Embodiment of a compressor according to the present invention, and it illustrates component parts around a hinge means when a swinging swash plate is inclined to the maximum inclination angle.

The Third Preferred Embodiment of the present compressor will be hereinafter described with reference to FIG. 7. FIG. 7 illustrates the component parts around the hinge means "K" of the Third Preferred Embodiment. The other constructions of the Third Preferred Embodiment are identical with those of the First Preferred Embodiment, and accordingly they are designated with the same reference numerals but will not be described hereinafter in detail.

In the hinge means "K," there is disposed a roller bearing 23 between the main guide pin 19 and the main guide hole 18*a* of the supporter arm 18.

In the thus constructed hinge means "K" of the Third Preferred Embodiment of the present compressor, the supporter arm 18 is disposed at the position where it is placed oppositely to the portions of the swinging swash plate 14, corresponding to piston 9 at the top dead center position. As a result, even when bending moments are exerted between the main guide pin 19 and the main guide hole 18*a* of the supporter arm 18, independent of the bending moments, the low friction coefficient of the roller bearing 23 helps the main guide pin 19 rotate smoothly in the main guide hole 18*a*.

The Third Preferred Embodiment of the present compressor can produce the advantageous effects similarly to those produced by the First Preferred Embodiment. In addition, even when it is operated under the low compression ratios, namely even when the swinging swash plate 14 is inclined from the smaller inclination angles to the larger inclination angles, it can respond to the enlarging compression ratios with an excellent sensitivity. Thus, in accordance with the Third Preferred Embodiment, it is possible to more securely inhibit the moments resulting from the compression reactive forces from interfering with the discharge capacity control.

Fourth Preferred Embodiment

Figure 8:
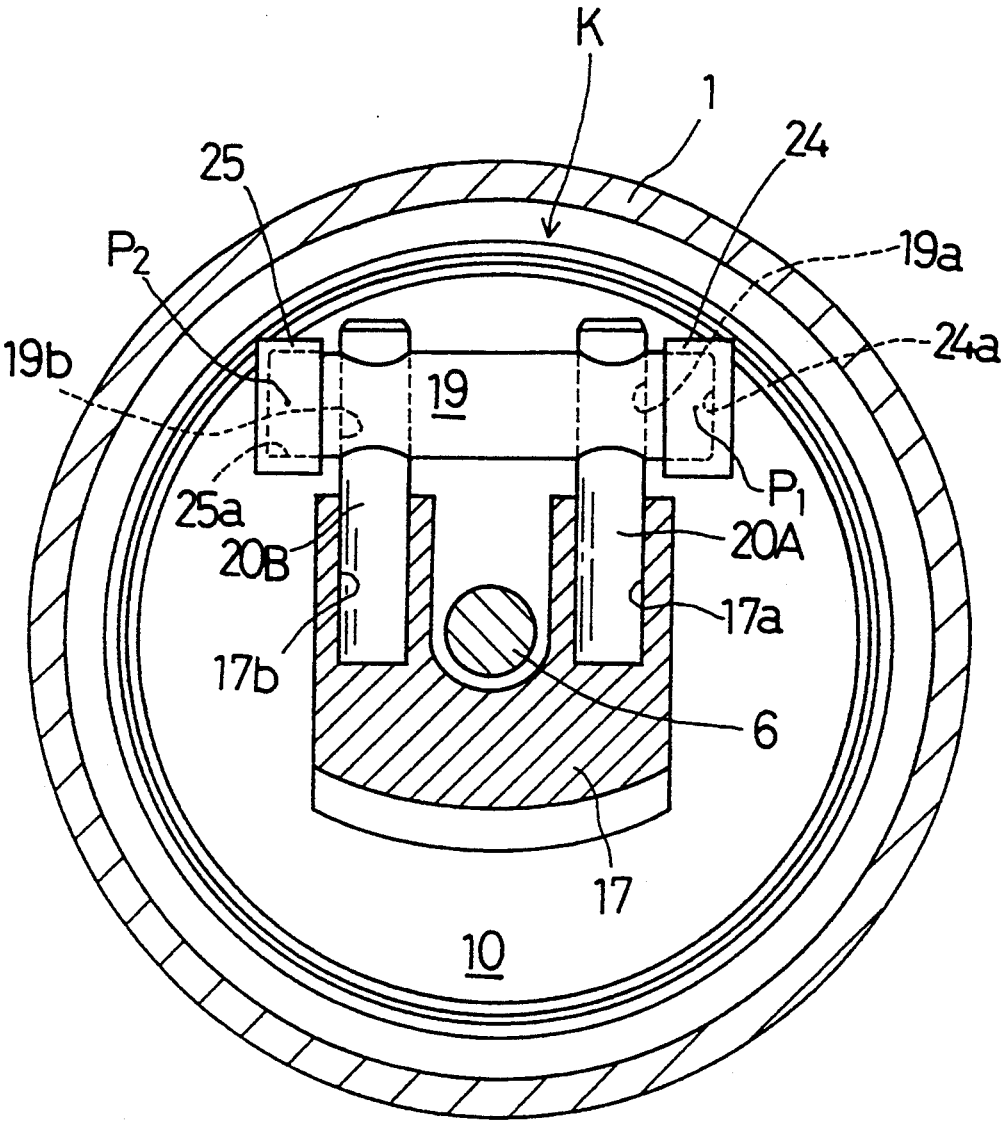
FIG. 8 is a lateral cross-sectional view of a Fourth Preferred Embodiment of a compressor according to the present invention, and it is taken along similarly to FIG. 2.
Figure 9:
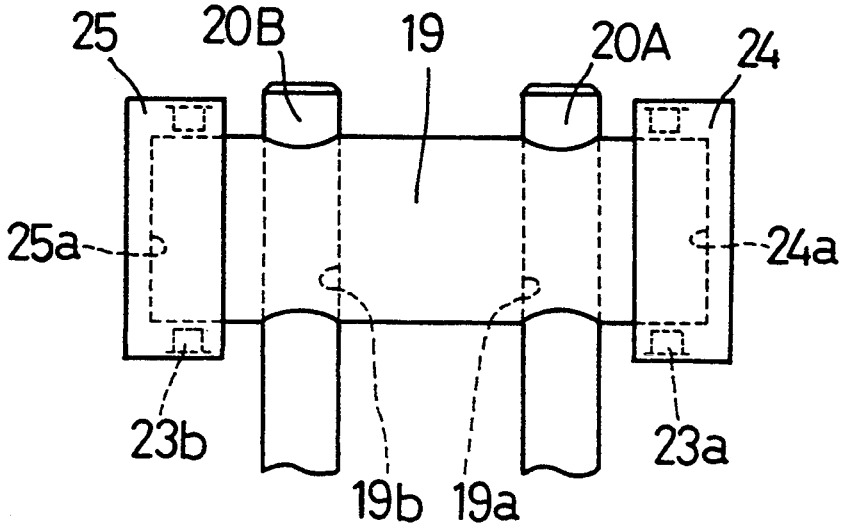
FIG. 9 is a schematic view of the Fourth Preferred Embodiment of the present compressor in part.
Figure 10:
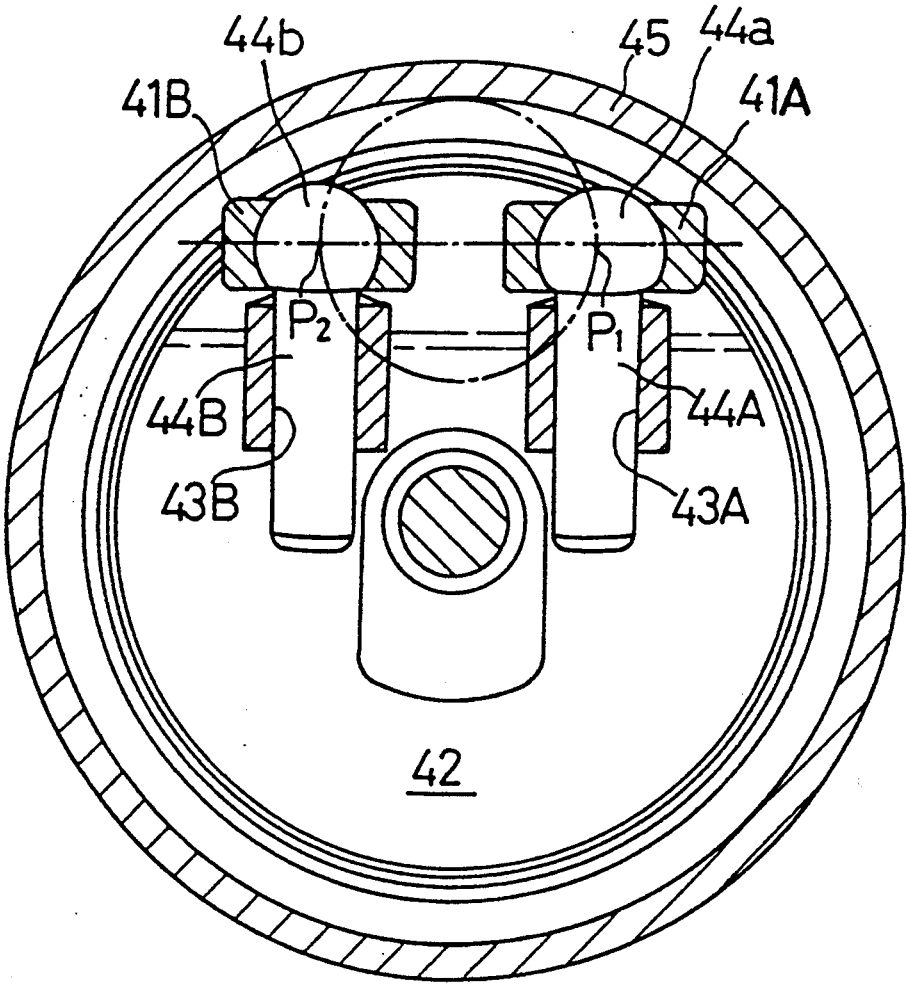
FIG. 10 is a lateral cross-sectional view of a compressor, which was proposed in U.S. Pat. No. 5,293,810, taken along line "10"—"10" of FIG. 11.
Figure 11:
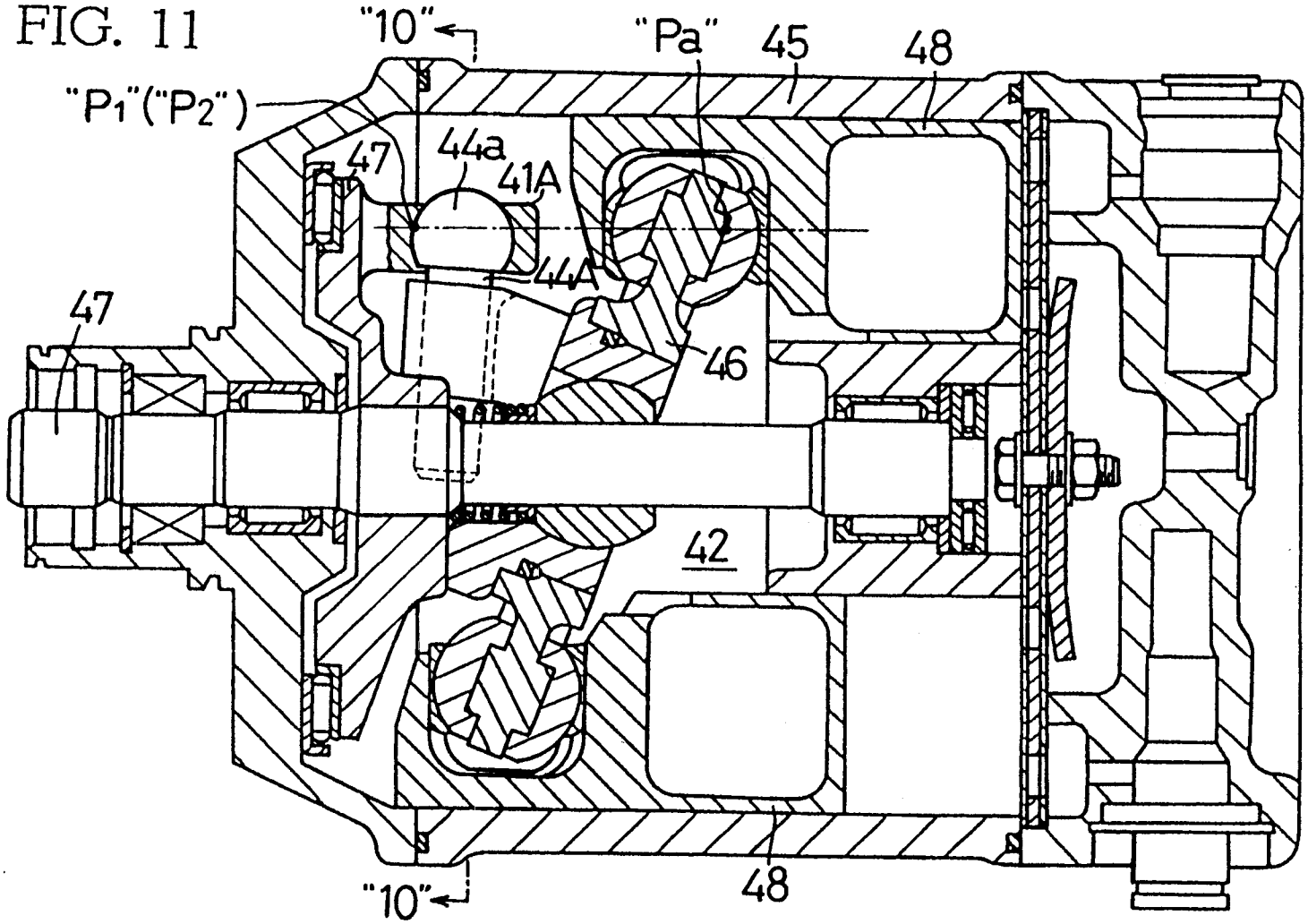
FIG. 11 is a longitudinal cross-sectional view of the compressor proposed proposed in advance.

The Fourth Preferred Embodiment of the present compressor will be hereinafter described with reference to FIGS. 8 and 9. FIGS. 8 and 9 illustrate the component parts around the hinge means "K" of the Fourth Preferred Embodiment. The other constructions of the Fourth Preferred Embodiment are identical with those of the First Preferred Embodiment, and accordingly they are designated with the same reference numerals but will not be described hereinafter in detail.

In the hinge means "K," there are disposed a pair of supporter arms 24, 25 whose supporting points "$P_1$," "$P_2$" are arranged so as to put the portions of the swinging swash plate 14, corresponding to the piston 9 at the top dead center position, therebetween. The supporter arms 24, 25 are provided with main guide holes 25*a*, 25*a*, respectively. The main guide holes 25*a*, 25*a* are disposed so as to face each other, and they are adapted to hold the ends of the main guide pip 19. As illustrated in FIG. 9, similar to the Third Preferred Embodiment, roller bearings 23*a*, 23*b* are disposed between the main guide pin 19 and the main guide holes 25*a*, 25*a* of the supporter arms 24, 25.

In the thus constructed hinge means "K" of the Fourth Preferred Embodiment of the present compressor, the pair of the supporter arms 24, 25 support the compression reactive forces dividedly. As a result, no bending moments are exerted between the main guide pin 19 and the main guide holes 25*a*, 25*a* of the supporter arms 24, 25. In addition, the low friction coefficient of the roller bearings 23*a*, 23*b* helps the main guide pin 19 rotate smoothly in the main guide holes 24*a*, 25*a*.

The Fourth Preferred Embodiment of the present compressor can produce the advantageous effects more effectively than the Third Preferred Embodiment does.

Figure 12:
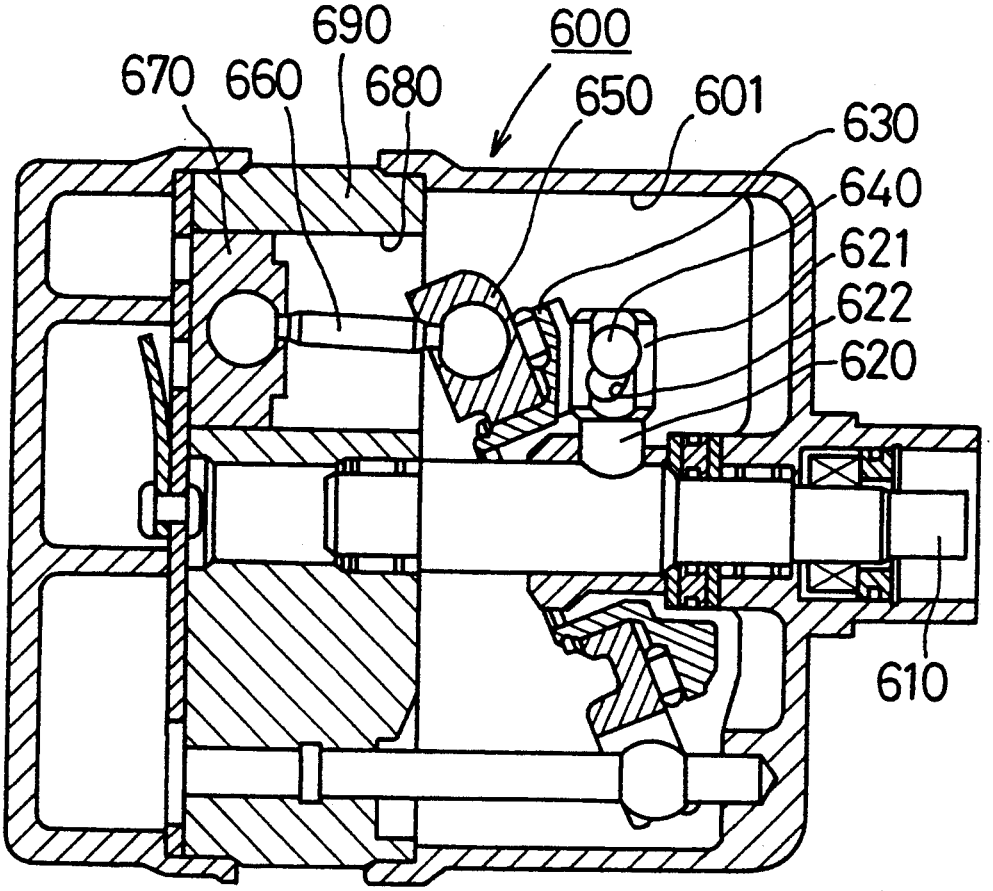
FIG. 12 (PRIOR ART)
FIG. 12 is a longitudinal cross-sectional view of the conventional compressor which is described in Japanese Unexamined Utility Model Publication (KOKAI) No. 62-183,082.

In the First through Fourth Preferred Embodiments of the present compressor, a connection means including piston rods adapted to connect the swinging swash plate 14 and the pistons 9 can substitute the connection means including the inner and outer shoes 15, 16. Such a connection means is the one used in the conventional compressor 600 as illustrated in FIG. 12.

Moreover, in the First through Fourth Preferred Embodiments of the present compressor, the present invention is applied to the compressor in which the swinging swash plate 14 rotates synchronously with the rotation of the driving shaft 6. However, the present invention is not limited thereto, it is applicable to the conventional compressor 600 earlier described with reference to FIG. 12 in which the wobble plate 650 slides relatively with respect to the rotary driving member 630 but it does not rotate.

Having now fully described the present invention, it will be apparent to one of ordinary skill in the art that many changes and modifications can be made thereto without departing from the spirit or scope of the present invention as set forth herein including the appended claims.

What is claimed is:

1. A variable capacity type swash plate compressor, comprising:

a housing including a crank chamber, a suction chamber, a discharge chamber, and a plurality of cylinder bores connected to the chambers, each of which is defined and formed therein;

a plurality of pistons disposed reciprocally in said cylinder bores;

a driving shaft disposed rotatably in said housing;

a rotor disposed synchronously rotatably on said driving shaft, and placed in said-crank chamber;

a swinging swash plate disposed about said driving shaft axially and inclinably positionable relative thereto and rotatable therewith;

hinge means disposed between said rotor and said swinging swash plate, said hinge means including:

a supporter arm disposed on said rotor projectably toward said swinging swash plate, and including a main guide hole extending in a direction perpendicular to the axial direction of said driving shaft;

a main guide pin inserted rotatably into said main guide hole; and an auxiliary guide pin extending and crossing perpendicularly with the main guide pin, said auxiliary guide pin having one end slidably inserted into an auxiliary guide hole formed in one of the main guide pin and said swinging swash plate, and having its other end fixed to the other one of said main guide pin and said swinging swash plate;

connecting means disposed between said pistons and said swinging swash plate, and adapted to convert swinging movements of said swinging swash plate-into reciprocal movements of said pistons; and means for controlling the pressure in said crank chamber for controlling the inclination of said swinging swash plate to vary the discharge capacity of the compressor.

2. The variable capacity type swash plate compressor according to claim 1, wherein a rolling-contact bearing is disposed between said main guide pin and said main guide hole of said supporter arm.

3. The variable capacity type swash plate compressor according to claim 1, wherein said supporter arm of said hinge means includes said main guide hole which is formed in a pair, the pair of the main guide holes are disposed so as to put portions of said swinging swash plate, corresponding to said piston at the top dead center position, between themselves, and the main guide holes are adapted to hold both ends of said main guide pin.

4. The variable capacity type swash plate compressor according to claim 3, wherein a pair of rolling-contact bearings are disposed between said main guide pin and said main guide holes of said supporter arm.

5. The variable capacity type swash plate compressor according to claim 2, wherein said rolling-contact bearing is a roller bearing.

6. The variable capacity type swash plate compressor according to claim 1, wherein said main guide pin includes said auxiliary guide hole, said auxiliary guide pin is slidably inserted into said auxiliary guide hole of said main guide pin at said one end, and said auxiliary guide pin is fixed to said swinging swash plate at said other end.

7. The variable capacity type swash plate compressor according to claim 1, wherein said swinging swash plate includes said auxiliary guide hole, said auxiliary guide pin is slidably inserted into said auxiliary guide hole of said swinging swash plate at said one end, and said auxiliary guide pin is fixed to said main guide pin at said other end.

8. The variable capacity type swash plate compressor according to claim 7, wherein said auxiliary guide hole of said swinging swash plate is formed in a through hole which penetrates through said swinging swash plate.

9. The variable capacity type swash plate compressor according to claim 1, wherein said swinging swash plate further includes a substantially "U"-shaped bracket disposed projectably therefrom toward said rotor and holding said driving shaft between its arms, said main guide pin includes a pair of said auxiliary guide holes formed adjacent its ends, a pair of said auxiliary guide pins are provided and have one of their ends slidably inserted into a corresponding one of said pair of said auxiliary guide holes of said main guide pin, and have the other of their ends fixed to the arms of the bracket.

10. The variable capacity type swash plate compressor according to claim 1, wherein said swinging swash plate further includes a substantially "U"-shaped bracket disposed projectably therefrom toward said rotor and holding said driving shaft between its arms, the bracket includes a pair of said auxiliary guide holes formed in the arms, a pair of said auxiliary guide pins are provided and have one of their ends slidably inserted into a corresponding one of said pair of said auxiliary guide holes of said bracket, and have the other of their ends fixed to the main guide pin.

11. The variable capacity type swash plate compressor according to claim 1, wherein said hinge means includes a pair of said supporter arms which are disposed so as to put portions of said swinging swash plate, corresponding to said piston at the top dead center position, between themselves, and said main guide holes of said supporter arms are adapted to hold both ends of said main guide pin.

12. The variable capacity type swash plate compressor according to claim 4, wherein said rolling-contact bearing is a roller bearing.

13. The variable capacity type swash plate compressor according to claim 1, wherein said swinging swash plate is disposed about said driving shaft by way of a spherical sleeve and a rotary driving member.

* * * * *